US006347620B1

(12) United States Patent
Miyake

(10) Patent No.: US 6,347,620 B1
(45) Date of Patent: Feb. 19, 2002

(54) CONTROL VALVE UNIT

(75) Inventor: Toshihiko Miyake, Tokyo (JP)

(73) Assignee: Mitsubishi Denki Kabushik Kaisha, Tokyo (JP)

( * ) Notice: Subject to any disclaimer, the term of this patent is extended or adjusted under 35 U.S.C. 154(b) by 0 days.

(21) Appl. No.: 09/423,815

(22) PCT Filed: Apr. 23, 1998

(86) PCT No.: PCT/JP98/01860

§ 371 Date: Nov. 15, 1999

§ 102(e) Date: Nov. 15, 1999

(87) PCT Pub. No.: WO99/54650

PCT Pub. Date: Oct. 28, 1999

(51) Int. Cl.[7] ..... F02B 47/08

(52) U.S. Cl. ..... 123/568.29; 123/568.11; 123/339.1

(58) Field of Search ..... 123/568.29, 568.11, 123/568.27, 339.1, 568.19, 568.2, 518, 519, 520; 60/278

(56) References Cited

U.S. PATENT DOCUMENTS

| | | | | |
|---|---|---|---|---|
| 3,807,375 A | | 4/1974 | Hertfelder | 123/568.19 |
| 3,981,283 A | * | 9/1976 | Kaufman | 123/119 |
| 3,990,418 A | * | 11/1976 | Nohira et al. | 123/119 |
| 4,158,351 A | | 6/1979 | Ando et al. | 123/568.2 |
| 4,256,076 A | * | 3/1981 | Bradshaw | 123/568 |
| 4,373,497 A | * | 2/1983 | Hamren | 123/571 |
| 4,446,832 A | * | 5/1984 | Matsumura et al. | 123/339 |

FOREIGN PATENT DOCUMENTS

| | | |
|---|---|---|
| EP | 416 788 | 3/1991 |
| JP | 58-037374 | 3/1983 |
| JP | 58-178563 | 11/1983 |
| JP | 59-34057 | 3/1984 |
| JP | 3-92682 | 4/1991 |
| JP | 6-280686 | 10/1994 |
| JP | 7-310607 | 11/1995 |
| WO | WO 97/44580 | 11/1997 |

* cited by examiner

*Primary Examiner*—Willis R. Wolfe
*Assistant Examiner*—Mahmoud Gimie
(74) *Attorney, Agent, or Firm*—Sughrue Mion, PLLC

(57) ABSTRACT

In an EGR valve or an ISC valve used as a control valve assembly for regulating the flow amount of a controlled fluid flowing through an internal combustion engine of an automobile, etc., in order to enable good sliding of a valve shaft to be maintained and, in addition, to achieve stable shaft positioning and holding performance with respect to the linear motion of the valve shaft even when carbon or foreign matter is contained in a controlled fluid, a fluid passage is provided within a housing, a regulating valve for regulating the flow of the controlled fluid flowing though the fluid passage is disposed in the fluid passage, a valve shaft is provided to support the regulating valve, an actuator for opening and closing the regulating valve by actuating the valve shaft is disposed at one end of the valve shaft, a first shaft-bush for supporting the valve shaft so that it slides freely is mounted to the housing on one side of the regulating valve, and an elastic second shaft-bush for supporting the valve shaft so that it slides freely is held on the housing by a holding member on the other side of the regulating valve.

7 Claims, 8 Drawing Sheets

CONTROL VALVE UNIT

TECHNICAL FIELD

The present invention relates to a control valve assembly for regulating the flow amount of exhaust gas or intake gas flowing through an internal combustion engine of an automobile, etc., by opening and closing a valve by linear motion.

BACKGROUND ART

With the operation of an internal combustion engine of an automobile, etc., exhaust gas or intake gas, which is a controlled fluid, flows and the flow amount of the controlled fluid is regulated by control valve assemblies. The flow amount of the controlled fluid may be regulated, for example, by an exhaust gas recirculation valve (hereinafter EGR valve) or by an idle speed control valve (hereinafter ISC valve), functioning as a control valve assembly.

FIG. 5 is a schematic structural diagram of a conventional EGR valve as shown in Japanese Utility Model Publication No. 6-14054, and FIG. 6 is a cross-sectional view showing the construction of the EGR valve in FIG. 5.

In FIGS. 5 and 6, exhaust gas conveyed from an exhaust pipe 3 connected to a combustion chamber 2 in an engine 1 is cooled by a cooler 4, then conveyed to an EGR valve 5 for regulating the recirculation of the exhaust gas to an intake pipe (not shown) in the engine 1. The flow amount of the exhaust gas is regulated by a regulating valve 6 disposed in the EGR valve 5 for regulating the opening of an exhaust gas passage in response to a negative-pressure signal from the intake pipe. This exhaust gas is resupplied to the intake pipe. In this manner, the exhaust gas is recombusted in the engine 1, thus reducing toxic nitrogen oxides in the exhaust gas. Moreover, the regulating valve 6 is operated by the pressure difference in a negative-pressure chamber 8 formed above a diaphragm 7.

A housing 10 is provided with an input port 11 connected to the exhaust pipe 3 of the engine 1, an output port 12 connected to the intake pipe of the engine 1, and a fluid passage 13 in which the exhaust gas which is the controlled fluid flows. Partway along the fluid passage 13, the regulating valve 6 contacting a valve seat 14 formed within the housing 10 is connected to a valve shaft 15 and slides within a shaft-bush 16 secured to the housing 10. A holder 17 disposed below the shaft-bush 16 in an upper portion of the fluid passage 13 prevents penetration by carbon or foreign matter contained in the exhaust gas.

Moreover, although not shown in the figures in some cases, penetration by carbon or foreign matter contained in the exhaust gas is prevented by disposing labyrinth packing, shielding, metal-fiber packing, and the like, inside the holder 17.

The diaphragm 7 is sandwiched by keep plates 20*a*, 20*b*, and the upper end 21 of the valve shaft 15 is mounted on the central portion thereof by crimping. A lower negative-pressure case 22 is disposed in close contact with an upper portion of the shaft-bush 16 and is attached to the housing 10 by a screw 23 through packing 27 described below. The negative-pressure chamber 8 is formed between the diaphragm 7 and an upper negative-pressure case 24 and negative pressure is introduced thereto from a negative-pressure source (not shown) by means of a negative-pressure inlet pipe 25 passing through and mounted on the upper negative-pressure case 24 which cooperates with the lower negative-pressure case 22 to hold the perimeter of the diaphragm 7 therebetween. Moreover, the regulating valve 6 connected to the valve shaft 15 is pressed downwards by a spring 26 disposed inside the upper negative-pressure case 24, but the diaphragm 7 may move upwards depending on the magnitude of the negative pressure conveyed to the negative-pressure chamber 8, and for that reason the regulating valve 6 may be driven upwards, varying the opening of the regulating valve 6. The packing 27 is interposed between the housing 10 and the lower negative-pressure case 22 and shuts out the heat from the housing 10.

In a construction having a single shaft-bush such as that in FIG. 6, because the amount of fluid controlled by EGR valves has increased with the strengthening of exhaust gas regulations, or because the amount of exhaust from truck engines 1 is large and the recirculation of exhaust gas by EGR valves for trucks is great, the need for large bores has increased even in the case of single regulating valves, and therefore, there has been a tendency for the weight on the end of the valve shaft to be problematic. FIG. 7 shows a control valve assembly in which both ends of a valve shaft having a regulating valve secured thereto are held by shaft-bushes or brace plates in order to improve linear-drive control valve assemblies in which stable retention against the vibrations, etc., of the internal combustion engine was difficult with only a single shaft-bush as above.

FIG. 7 is a cross-sectional view showing the construction of another conventional EGR valve such as that disclosed in Japanese Patent Application Laid-Open No. 58-37374, for example.

In the numbering used in FIG. 7, the same numbering as that used in FIG. 6 represents identical or corresponding parts. The construction shown in FIG. 7 has, in addition to the construction of FIG. 6, a valve shaft 15 connected to the regulating valve 6 extending beyond the regulating valve 6, an end portion 15*a* thereof being guided by insertion into the central boss 30*a* of a brace plate 30 secured to the housing 10.

Meanwhile, there may be large surges in the controlled fluid, and FIG. 8 shows a control valve assembly in which two regulating valves are disposed coaxially, so that the pressure of the controlled fluid is applied to the two regulating valves in mutually opposite directions in order to cancel out these surges. In this construction, the valve shaft securing the regulating valves must be lengthened.

FIG. 8 is a cross-sectional view showing the construction of a conventional ISC valve such as that disclosed in Japanese Utility Model Application Laid-Open No. 58-4759, for example.

In the numbering used in FIG. 8, the same numbering as that used in FIG. 6 or 7 represents identical or corresponding parts. The ISC valve shown in FIG. 8 has a valve shaft 15 contacting a plunger rod 32 moved linearly by a solenoid coil 31, and two regulating valves 6 connected thereto. Because the length of extension of the valve shaft 15 beyond the shaft-bush 16 secured to the housing 10 on the solenoid coil 31 side is particularly large and cannot be supported by the shaft-bush 16 alone, an end portion 15*a* of the valve shaft 15 at the opposite end from that contacting the solenoid coil 31 being the drive source for opening and closing the regulating valve 6 is guided by insertion into the central boss 30*a* of the brace plate 30, in the same way as in FIG. 7, with the aim of stabilizing sliding. In addition, in order to avoid deterioration of sliding due to carbon or foreign matter contained in the controlled fluid penetrating the sliding portion between the valve shaft 15 and the shaft-bush 16 or the sliding portion between the central boss portion 30*a* and the end portion 15*a*, the central boss portion 30*a* of the brace plate 30 constructed in the fluid passage 13 is constructed such that a shielding material 33 capable of expanding and contracting freely relative to the linear motion so as not to affect the sliding covers the shaft-bush 16 on the side nearest to the fluid passage 13, or the central boss portion 30*a* and the end portion 15*a*.

However, because conventional EGR valves and ISC valves have had the above constructions, they have suffered from the problems described below.

In a control valve assembly in which both sides of the regulating valve secured to the valve shaft are held by bushes or brace plates in order to achieve linear motion stabilized against the vibrations of the internal combustion engine, etc., the shaft-bush holding the valve shaft connected to the diaphragm or the solenoid coil being the drive source for opening and closing the regulating valve and the brace plate disposed on the opposite side are installed in the fluid passage. For that reason, when the controlled fluid contains carbon or foreign matter, carbon or foreign matter penetrates the sliding portion between the central boss portion of the brace plate and the valve shaft.

In addition, since the central boss portion of the brace plate is installed in the fluid passage, a blind recess is formed making it difficult to flush out any foreign matter which has penetrated. Furthermore, when the controlled fluid is a high-temperature gas, the gas is cooled in the small gap formed by the blind recess, facilitating the formation of condensation, and there is a risk that corrosion or solidification of any foreign matter which has penetrated will obstruct stable sliding of the valve shaft.

Furthermore, in a construction in which both ends of the valve shaft are slidably held by rigid valve bushes or brace plates, concentricity is required between the shaft-bush and the central boss portion of the brace plate in order to ensure stable sliding of the valve shaft, making high-precision machining necessary. Otherwise, if high-precision machining is not used, it has been difficult to ensure stable sliding of the valve shaft without reducing the precision of the valve shaft support by enlarging the space between the central boss portion and the valve shaft.

Consequently, the present invention aims to provide a control valve assembly enables a valve shaft to maintain good sliding even when a controlled fluid contains carbon or foreign matter.

Furthermore, the present invention additionally aims to provide a control valve assembly for an internal combustion engine enabling stable shaft positioning and holding performance relative to the linear motion of the valve shaft.

DISCLOSURE OF THE INVENTION

The present invention comprises a fluid passage disposed inside a housing, a regulating valve disposed inside the fluid passage for regulating the flow of a controlled fluid flowing through the fluid passage, a valve shaft for supporting the regulating valve, and an actuator disposed at one end of the valve shaft for opening and closing the regulating valve by actuating the valve shaft, a first shaft-bush mounted to the housing on one side of the regulating valve for slidably supporting the valve shaft, and an elastic second shaft-bush held on the housing by a holding member on the opposite side of the regulating valve for slidably supporting the valve shaft. Thus, even if carbon or foreign matter contained in the controlled fluid accretes between the valve shaft and the second shaft-bush, good sliding between the valve shaft and the second shaft-bush can be maintained with the carbon or foreign matter being scraped away by a small sliding resistance, and misalignment of the axes between the first shaft-bush and the second shaft-bush can be absorbed, the need for high-precision machining in the second shaft-bush can also be eliminated, and further stable shaft positioning and holding performance can be achieved.

The present invention may also comprise a second shaft-bush formed from fine metal wire. Thus, because the valve shaft and an inside diameter portion of the second shaft-bush are placed in contact with each other with elastic and uniform force, the valve shaft can slide on the minimal surface area of the fine metal wire. Furthermore, even if high-viscosity carbon and foreign matter in the exhaust gas composed of components with a range of molecular weights accretes between the valve shaft and the second shaft-bush, the carbon or foreign matter can be scraped away by the small sliding resistance, and misalignment of the axes between the first shaft-bush and the second shaft-bush can be absorbed, the need for high-precision machining in the second shaft-bush can also be eliminated, and further stable shaft positioning and holding performance can be achieved. In addition, since the flow around the second shaft-bush portion is improved, even if the controlled fluid is a high-temperature gas, the occurrence of condensation by cooling of the gas is prevented, enabling the suppression of corrosion or the solidification of any foreign matter which has penetrated.

The present invention may also be provided with a recess on the opposite side of the second shaft-bush from the fluid passage. Thus, even if carbon or foreign matter contained in the controlled fluid accretes between the valve shaft and the second shaft-bush, it can be scraped away by the second shaft-bush and allowed to accumulate in the recess.

In the present invention, the holding member may also be provided with at least one aperture for circulation through the fluid passage and the recess portion. Thus, since most of the controlled fluid flows through the aperture, the amount of carbon and foreign matter in the controlled fluid flowing between the valve shaft and the second shaft-bush can be reduced.

In the present invention, the holding member may be designed such that the second shaft-bush is removably mounted. Thus, the holding member can be mounted to the second shaft-bush before the holding member is installed in the housing, reducing the attention required when conveying or handling the second shaft-bush, a body shaped from fine metal wire, thereby enabling the assembly operation to be improved, and weight to be reduced.

In the present invention, the recess may be designed so as to be removably mounted. Thus, carbon or foreign matter from the controlled fluid which has accumulated in the recess can be removed.

The present invention may also comprise a fluid passage disposed inside a housing, a regulating valve disposed inside the fluid passage for regulating the flow of a controlled fluid flowing through the fluid passage, a valve shaft for supporting the regulating valve, an actuator for opening and closing the regulating valve by actuating the valve shaft, and an elastic shaft-bush mounted to the housing for supporting the valve shaft at least one point so as to slide freely. Thus, even if carbon or foreign matter contained in the controlled fluid accretes between the valve shaft and the second shaft-bush, good sliding of the valve shaft can be maintained, and misalignment of the axes between the shaft-bushes bush can be absorbed when a plurality of shaft-bushes are used, the need for high-precision machining in the elastic shaft-bush can be eliminated, and stable shaft positioning and holding performance can be achieved.

BEST MODE FOR CARRYING OUT THE INVENTION

Figure 5:
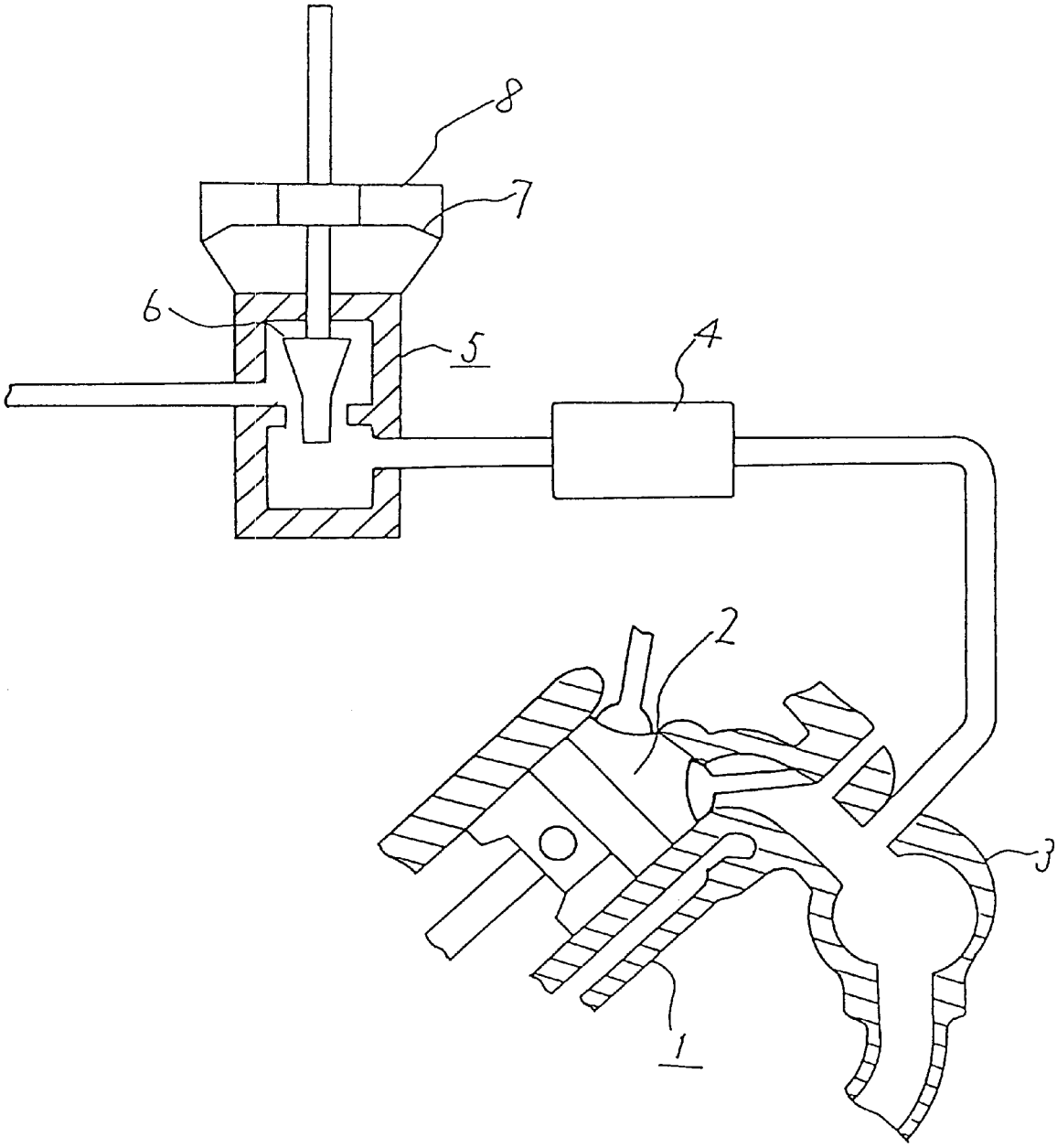
PRIOR ART FIG. 5
FIG. 5 is a schematic structural diagram of a conventional EGR valve.
Figure 6:
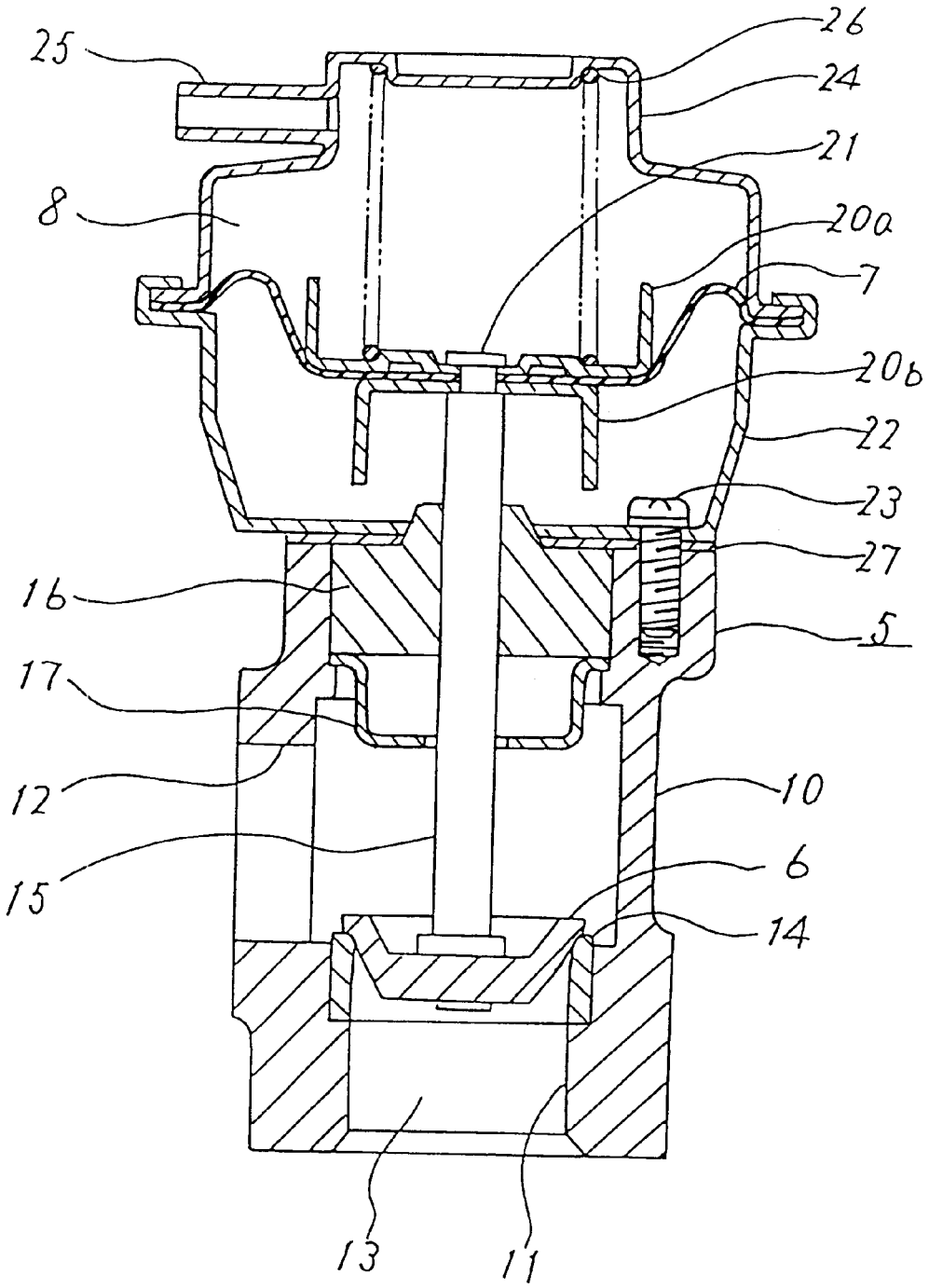
PRIOR ART FIG. 6
FIG. 6 is a cross-sectional view showing the construction of the EGR valve in FIG. 5.
Figure 7:
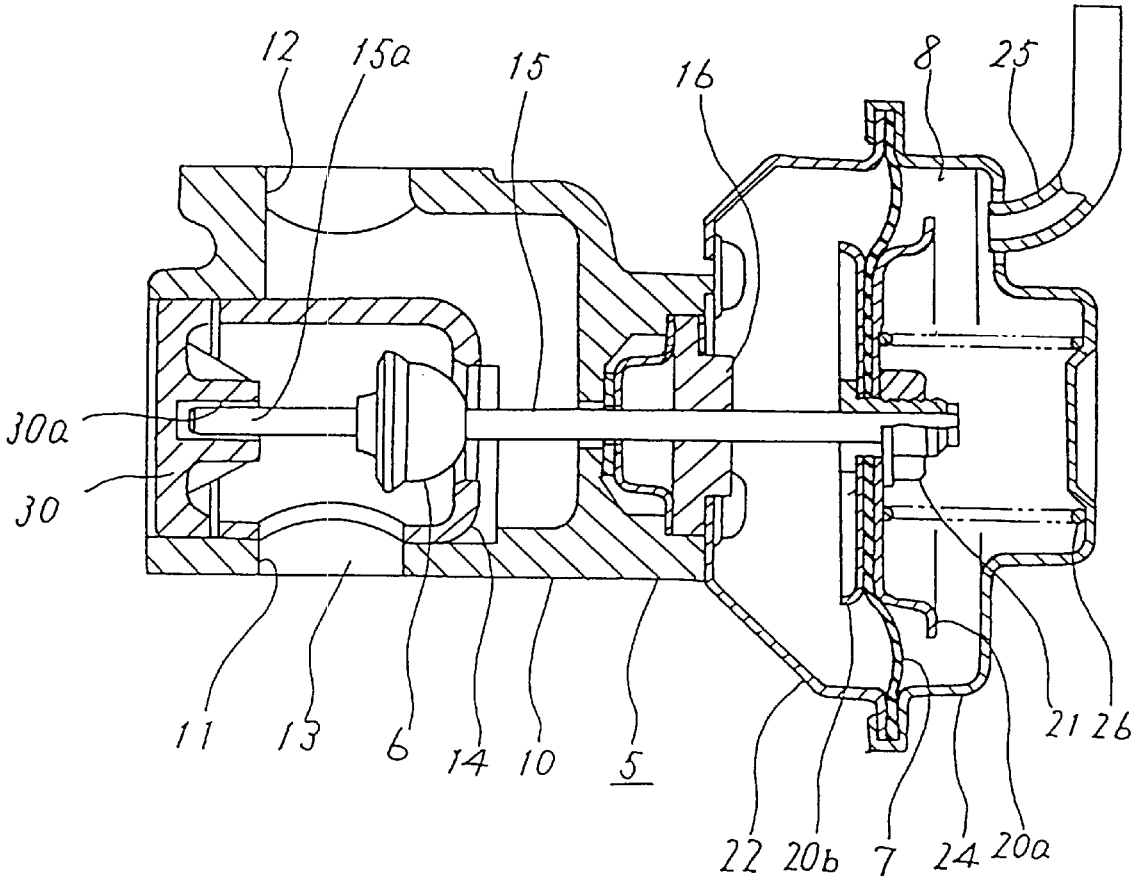
PRIOR ART FIG. 7
FIG. 7 is a cross-sectional view showing the construction of another conventional EGR valve.
Figure 8:
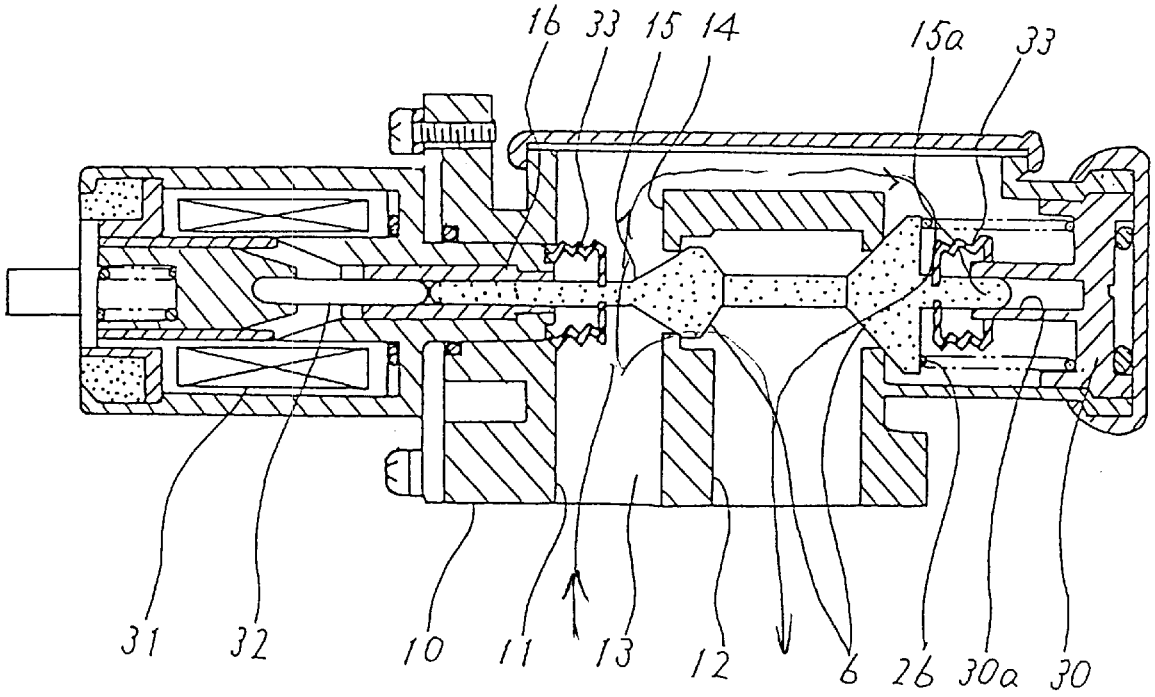
PRIOR ART FIG. 8
FIG. 8 is a cross-sectional view showing the construction of a conventional ISC valve.

The present invention will now be explained in detail with reference to the attached drawings. Moreover, the present invention relates to a control valve assembly, for example, a control valve assembly having a construction in which both sides of a regulating valve secured to a valve shaft in an EGR valve or an ISC valve are held by a shaft-bush or a brace plate. Consequently, since the same construction applies in the case of either an EGR valve or an ISC valve, the present invention will be explained below using an EGR valve. Furthermore, the construction and action of the schematic structural diagram in FIG. 5 represents the same construction and action as the present invention.

Figure 1:
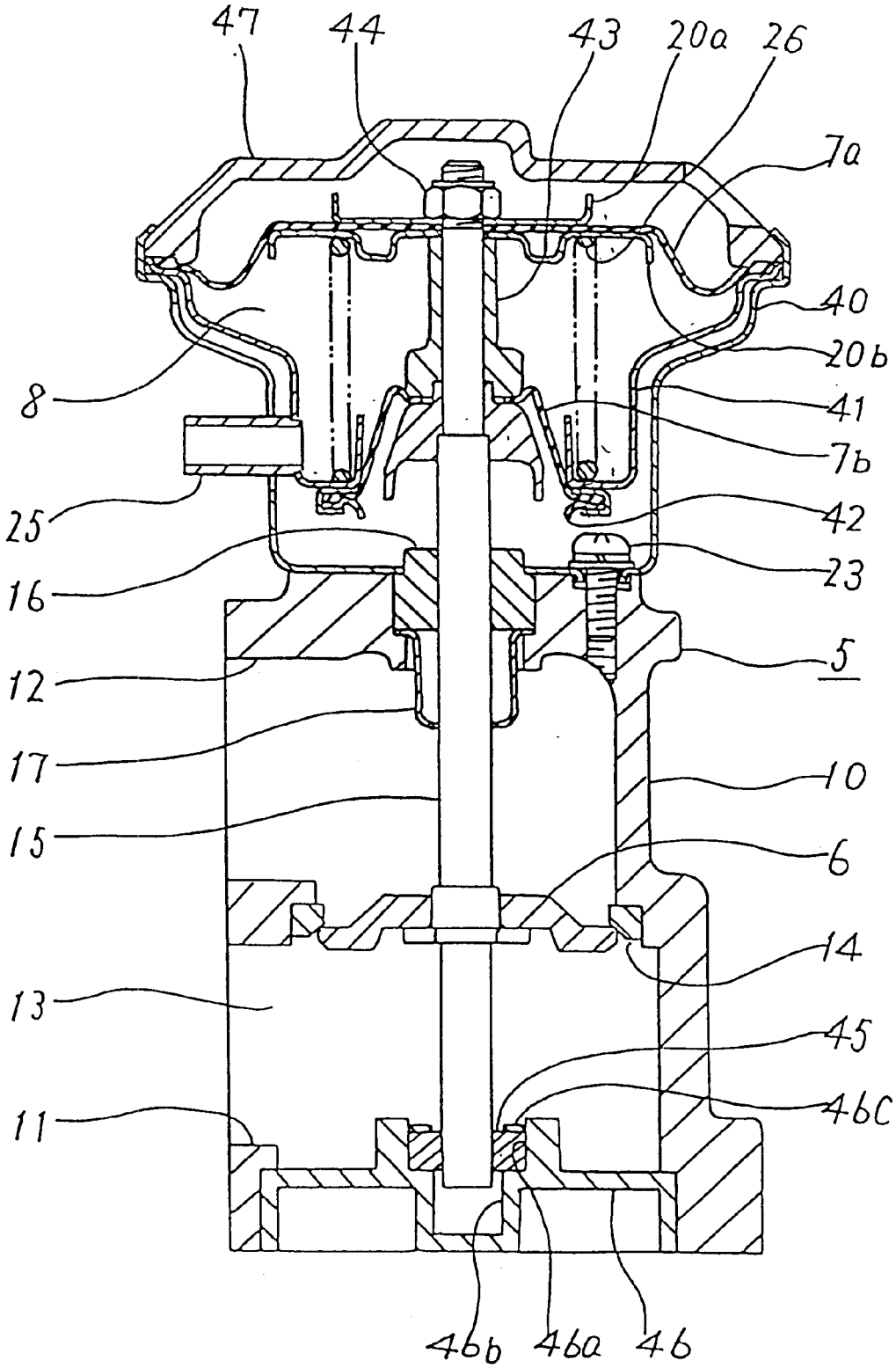
FIG. 1 is a cross-sectional view showing the construction of a control valve assembly according to Embodiment 1 of the present invention.

FIG. 1 is a cross-sectional view showing the construction of a control valve assembly according to Embodiment 1 of the present invention.

In FIG. 1, an EGR valve 5 is mainly comprises the following parts. A cast-iron housing 10 is provided with a fluid passage 13 therein comprising an input port 11 and an output port 12, and exhaust gas which is a controlled fluid flows through the fluid passage 13. A stainless regulating valve 6 is disposed within the fluid passage 13 comes into contact with a stainless valve seat 14 formed inside the housing 10 for regulating the amount of controlled fluid flowing through the fluid passage 13. A stainless valve shaft 15 is connected to the regulating valve 6 for supporting the regulating valve 6. A rubber diaphragm 7*a* is held between keep plates 20*a*, 20*b* inside a metal bracket 40 mounted to the housing 10 by a screw 23 and is subjected to a downward action due to negative pressure introduced to a negative-pressure chamber 8 between the rubber diaphragm 7*a* and a metal negative-pressure case 41 via a negative-pressure inlet pipe 25. A rubber diaphragm 7*b* is held centrally by a metal spacer 43 for maintaining the spacing between a metal keep plate 42 and the diaphragm 7*a* and is secured together with the diaphragm 7*a* and the keep plates 20*a*, 20*b* by being fastened by a nut 44, forming a seal between the negative-pressure chamber 8 and the valve shaft 15. The outer circumference of the diaphragm 7*b* is secured by crimping to a second edge of the negative-pressure case 41, a first edge of which is connected to the housing 10 by being held between a bracket 40 and a metal or resin cover 47. A spring 26 is disposed between the diaphragm 7*a* and the negative-pressure case 41, and the action thereof pushes the diaphragms 7*a*, 7*b* upwards, but the diaphragms 7*a*, 7*b* move downwards in response to the magnitude of the negative pressure introduced to the negative-pressure chamber 8, and thus the regulating valve 6 is actuated downwards changing the degree of opening of the regulating valve 6. The diaphragms 7*a*, 7*b*, the negative-pressure chamber 8, the keep plates 20*a*, 20*b*, 42, the nut 44, the negative-pressure case 41, the spacer 43, the bracket 40, and the cover 47 constitute an actuator for opening and closing the regulating valve 6, and are disposed at one end of the valve shaft 15.

A shaft-bush 16 is made of carbon or a sintered copper-based alloy mounted to the housing 10 on one side of the regulating valve 6 for slidably supporting the valve shaft 15, and a stainless holder 17 is disposed below the shaft-bush 16 for preventing carbon or foreign matter contained in the exhaust gas passing through the fluid passage 13 from penetrating into the shaft-bush 16 or accreting to the valve shaft 15 which slides though the shaft-bush 16.

Moreover, although not shown, carbon or foreign matter contained in the exhaust gas passing through the fluid passage 13 may be prevented from penetrating into the shaft-bush 16 or accreting to the valve shaft 15 which slides though the shaft-bush 16 by disposing labyrinth packing, shielding, metal fiber packing, or the like, inside the holder 17.

An elastic shaft-bush 45 is held on the housing on the opposite side of the regulating valve 6 by a holding plate 46 for slidably supporting the valve shaft 15. The shaft-bush 45 has an inside diameter slightly smaller than the outside diameter of the valve shaft 15 and an outside diameter slightly larger than the inside diameter of a boss 46*a* described below, and is formed into a cylindrical shape by braiding a single strand of fine stainless metal wire having a diameter of 0.15 mm, for example, so as to be elastic, and winding the braid into a roll. The holding plate 46 is stainless, a boss 46*a* is formed at the center thereof for holding the shaft-bush 45, and a recess 46*b* having a diameter larger than the outside diameter of the valve shaft 15 is formed on the opposite side from the boss 46*a*. The holding plate 46*c* has an inside diameter larger than the outside diameter of the valve shaft 15 and an outside diameter slightly larger than the inside diameter of the boss 46*a*, and is secured by press fitting or by crimping the upper edge of the inside diameter of the boss 46*a* after inserting the shaft-bush 45 inside the boss 46*a*.

By employing this soft of a construction of this kind, because the valve shaft 15 and the inside diameter portion of the shaft-bush 45 are placed in contact with elastic and uniform force by holding the shaft-bush 45 with the holding plate 46, the valve shaft 15 can slide and be supported by the minimal surface area of the fine metal wire. Furthermore, even if high-viscosity carbon and foreign matter in the exhaust gas composed of components with a range of molecular weights accretes to the valve shaft 15, the carbon or foreign matter can be scraped away by a small sliding resistance and accumulated in the recess 46*b*. Furthermore, because the shaft-bush 45 is formed from fine metal wire, flow is improved, so that even if the controlled fluid is a high-temperature gas, the occurrence of condensation formed by cooling of the gas is prevented, enabling the suppression of corrosion and the solidification of foreign matter which has penetrated therein.

In addition, in supporting both ends of the valve shaft 15 so as to slide freely, because one end is supported by a rigid shaft-bush 16 and the other end is supported with elastic and uniform force by an elastic shaft-bush 45 formed from fine metal wire, misalignment of the axes of the shaft-bush 16 and the shaft-bush 45 can be absorbed. Furthermore, because there is no longer any need to provide spacing between the valve shaft 15 and the shaft-bush 45 for sliding, the need for high-precision machining in the shaft-bush 45 is eliminated, and also stable shaft positioning and holding performance can be achieved.

Moreover, in the above embodiment, the shaft-bush 45 is braided from fine metal wire and wound up into a roll to form a cylindrical shape, but the same effect can be achieved by forming the fine metal wire into an non-woven compact.

Next, a control valve assembly according to another embodiment of the present invention will be explained using FIG. 2.

Figure 2:
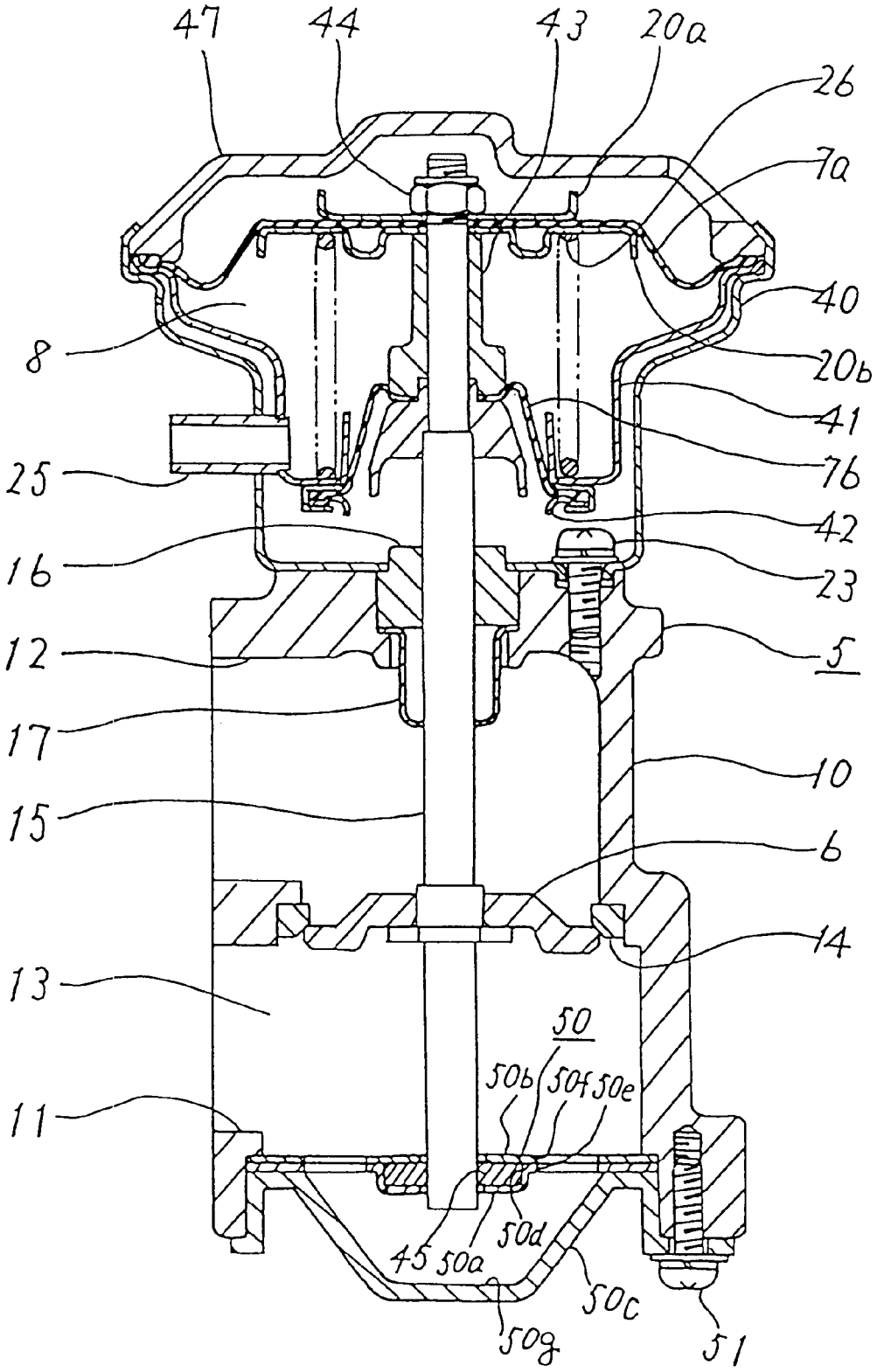
FIG. 2 is a cross-sectional view showing the construction of a control valve assembly according to Embodiment 2 of the present invention.

FIG. 2 is a cross-sectional view showing the construction of a control valve assembly according to Embodiment 2 of the present invention.

In the numbering used in FIG. 2, the same numbering as that used in FIG. 1 indicates the same or corresponding parts. FIG. 2 differs from FIG. 1 only in the construction of a stainless holding plate assembly 50 comprising holding plates 50*a*, 50*b*, 50*c*. The holding plate 50*a* having an aperture in the center thereof with a diameter greater than the outside diameter of the valve shaft 15, is formed with a boss 50*d* having a diameter smaller than the outside diameter of the shaft-bush 45, and has one or more apertures 50*e* outside the outer circumferential perimeter of a boss 50*d*. The holding plate 50*b* having an aperture in the center thereof with a diameter greater than the outside diameter of the valve shaft 15, has apertures 50*f* which are the same size and in the same positions as the apertures 50*e* in the holding plate 50*a*. The holding plate 50*c* has a recess 50*g* formed in the center thereof so as not to block the apertures 50*e*, 50*f*, and is mounted to the housing 10 by a screw 51.

By employing this sort of construction, the same operational effects as in Embodiment 1 are exhibited. Namely, because the valve shaft 15 and the inside diameter portion of the shaft-bush 45 are placed in contact with elastic and uniform force by holding the shaft-bush 45 with the holding plate assembly 50, the valve shaft 15 can slide and be supported by the minimal surface area of the fine metal wire. Furthermore, even if high-viscosity carbon and foreign matter in the exhaust gas composed of components with a range of molecular weights accretes to the valve shaft 15, the carbon or foreign matter can be scraped away by a small sliding resistance and accumulated in the recess 50*g*. Furthermore, because the shaft-bush 45 is formed from fine metal wire, flow is improved, so that even if the controlled fluid is a high-temperature gas, the occurrence of condensation formed by cooling of the gas is prevented, enabling the suppression of corrosion and the solidification of foreign matter which has penetrated. As a result, it is possible to provide a control valve assembly enabling good sliding of the valve shaft 15 to be maintained even when the controlled fluid contains carbon or foreign matter. Furthermore, in supporting both ends of the valve shaft 15 so as to slide freely, because one end is supported by a rigid shaft-bush 16, and the other end is supported with elastic and uniform force by an elastic shaft-bush 45 formed from fine metal wire, misalignment of the axes of the shaft-bush 16 and the shaft-bush 45 can be absorbed. Furthermore, because there is no longer any need to provide spacing between the valve shaft 15 and the shaft-bush 45 for sliding, the need for high-precision machining in the shaft-bush 45 is eliminated, and also stable shaft positioning and holding performance can be achieved.

In addition, because apertures 50*e*, 50*f* are provided and the recess portion 50*g* is disposed so as not to block the apertures 50*e*, 50*f*, most of the exhaust gas flows through the apertures 50*e*, 50*f*, enabling the amount of carbon and foreign matter contained in the exhaust gas flowing around the shaft-bush 45 to be reduced. Furthermore, any foreign matter which has accumulated in the recess 50*g* can be cleaned out by removing the screw 51 and the holding plate 50*c*.

Figure 3:
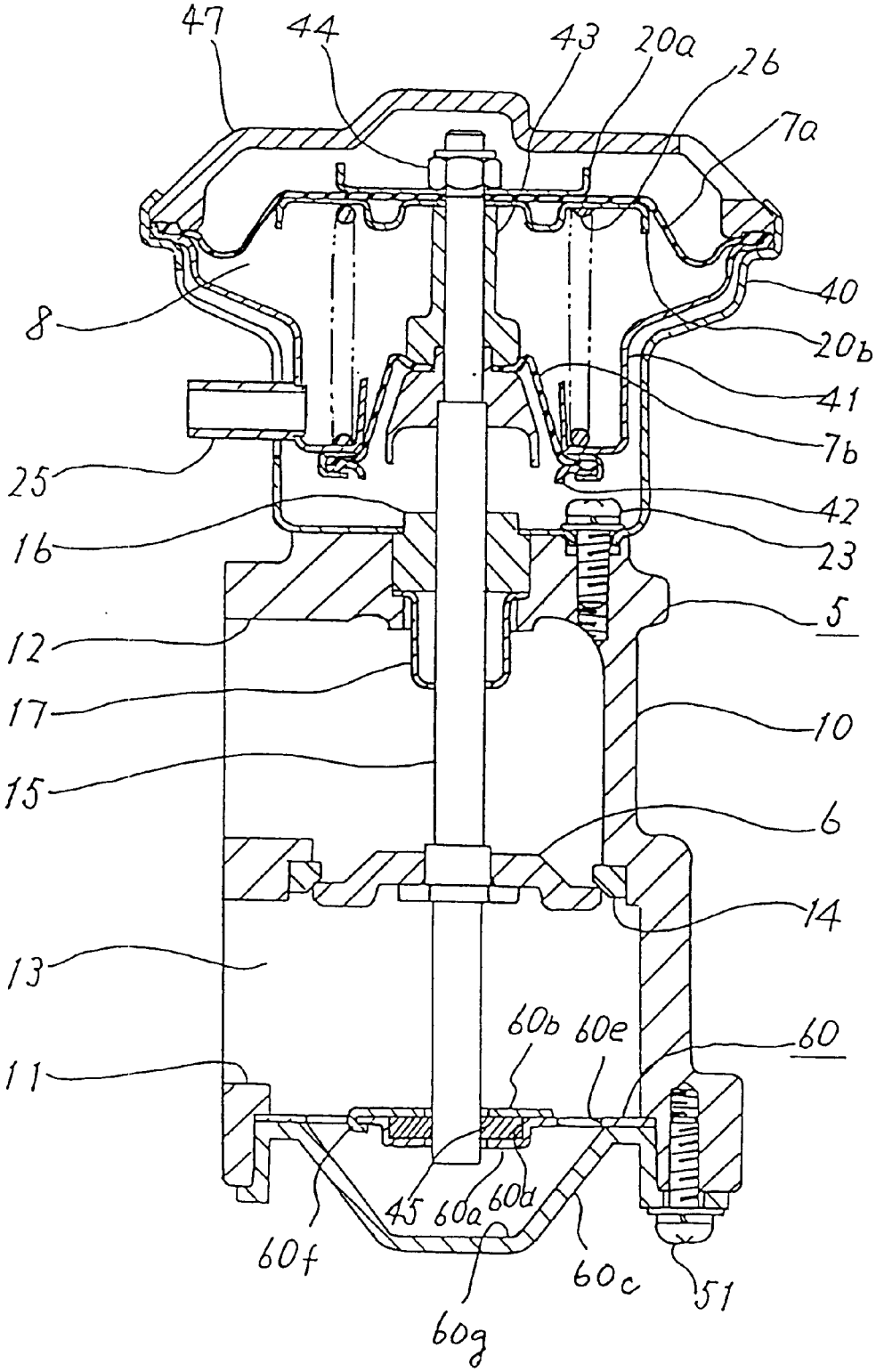
FIG. 3 is a cross-sectional view showing the construction of a control valve assembly according to Embodiment 3 of the present invention.
Figure 4:
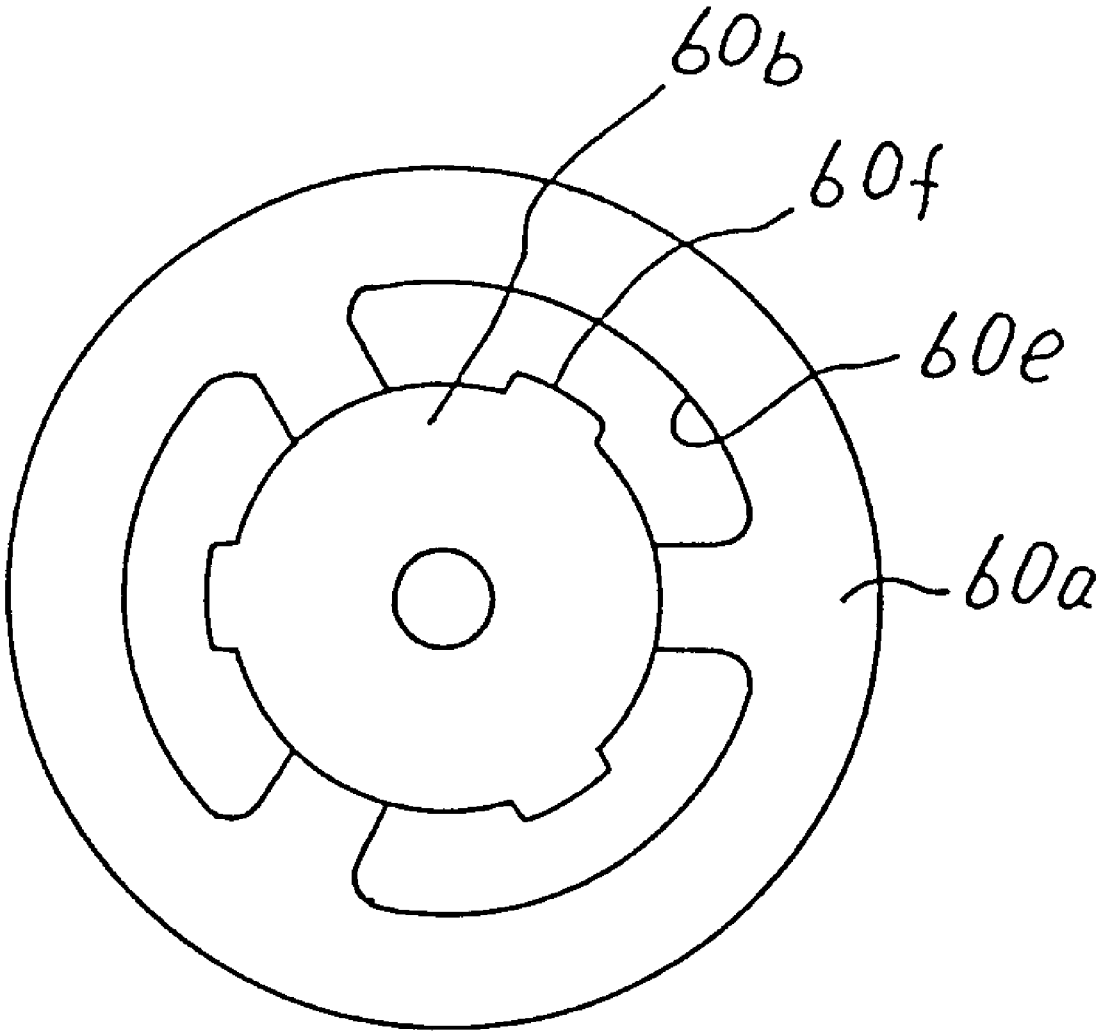
FIG. 4 is a partial plan view showing the holding member from FIG. 3.

FIG. 3 is a cross-sectional view showing the construction of a control valve assembly according to Embodiment 3 of the present invention. FIG. 4 is a partial plan view showing the holding member from FIG. 3.

In the numbering used in FIG. 3, the same numbering as that used in FIG. 2 indicates the same or corresponding parts. FIG. 3 differs from FIG. 2 only in the construction of a stainless holding plate assembly 60 comprising holding plates 60*a*, 60*b*, 60*c*. The holding plate 60*a* has an aperture in the center thereof having a diameter greater than the outside diameter of the valve shaft 15, is formed with a boss 60*d* having a diameter smaller than the outside diameter of the shaft-bush 45, and has one or more apertures 60*e* outside the outer circumferential perimeter of the boss 60*d*, as shown in FIG. 4. The holding plate 60*b* has an aperture in the center thereof having a diameter greater than the outside diameter of the valve shaft 15, is shaped into a disk being smaller than the inside of the apertures 60*e* in the holding plate 60*a*, and is provided with a plurality of tabs 60*f* around the outer circumferential edge thereof so as to grip the inside of the apertures 60*e*, being secured by bending and crimping the tips of the tabs 60*f*. The holding plate 60*c* has a recess 60*g* in the center thereof formed so as not to block the apertures 60*e*.

By using a construction of this kind, the same operational effects as in Embodiment 2 are exhibited. Namely, because the valve shaft 15 and the inside diameter portion of the shaft-bush 45 are placed in contact with elastic and uniform force by holding the shaft-bush 45 with the holding plate assembly 60, the valve shaft 15 can slide and be supported by the minimal surface area of the fine metal wire. Furthermore, even if high-viscosity carbon and foreign matter in the exhaust gas composed of components with a wide range of molecular weights accretes to the valve shaft 15, the carbon or foreign matter can be scraped away with a small sliding resistance and accumulated in the recess 60*g*. Furthermore, because the shaft-bush 45 is formed from fine metal wire, the flow is good, so that even if the controlled fluid is a high-temperature gas, the occurrence of condensation formed by cooling of the gas is prevented, enabling the suppression of corrosion and the solidification of any foreign matter which has penetrated. As a result, it is possible to provide a control valve assembly enabling good sliding of the valve shaft 15 to be maintained even when the controlled fluid contains carbon or foreign matter. Furthermore, in supporting both ends of the valve shaft 15 so as to slide freely, because one end is supported by a rigid shaft-bush 16, and the other end is supported with elastic and uniform force by an elastic shaft-bush 45 formed from fine metal wire, misalignment of the shaft-bush 16 and the shaft-bush 45 can be absorbed. Furthermore, because there is no longer any need to provide spacing between the valve shaft 15 and the shaft-bush 45 for sliding, the need for high-precision machining in the shaft-bush 45 is eliminated, and also stable shaft positioning and holding performance can be achieved. Furthermore, because apertures 60*e* are provided, and the recess portion 60*g* is disposed so as not to block the apertures 60*e*, most of the exhaust gas flows through the apertures 60*e*, enabling the amount of carbon and foreign matter contained in the exhaust gas flowing across the shaft-bush 45 to be reduced. Furthermore, any foreign matter which has accumulated in the recess 60*g* can be cleaned out by removing the screw 51 and the holding plate 60*c*.

In addition, whereas in the case of Embodiment 2, when assembling the holding plate assembly 50 in the housing 10, the shaft-bush 45 is inserted into the holding plate 50*a* and then the holding plate 50*b* is mounted, in the case of Embodiment 3, the shaft-bush 45 can be mounted to the holding plates 60*a*, 60*b* before mounting the holding plate assembly 60 to the housing 10, reducing the attention required when conveying or handling the shaft-bush 45 which is a body shaped from fine metal wire, thereby enabling the assembly operation to be improved, and weight to be reduced.

Moreover, in the above embodiments, shaft-bushes 16, 45 are disposed on both sides of the regulating valve 6, but a shaft-bush 16, 45 may be disposed on one side of the regulating valve only and the same operational effects will be exhibited.

INDUSTRIAL APPLICABILITY

As explained above, the control valve assembly according to the present invention applies to an EGR valve or an ISC valve as a control valve assembly enabling good sliding of a valve shaft to be maintained even when a controlled fluid contains carbon or foreign matter.

What is claimed is:

1. A control valve comprising:

a housing having a fluid passage therein;

a regulating valve disposed in said fluid passage for regulating the flow of a controlled fluid flowing through said fluid passage;

a valve shaft for supporting said regulating valve;

an actuator disposed at one end of said valve shaft for opening and closing said regulating valve by actuating said valve shaft;

a first shaft-bush mounted to said housing on one side of said regulating valve for slidably supporting said valve shaft; and an elastic second shaft-bush held on said housing on the other side of said regulating valve by a holding member for slidably supporting said valve shaft so as to slide freely;

wherein said second shaft-bush is formed from fine metal wire.

2. The control valve assembly according to claim 1 wherein said holding member is provided with a recess on the opposite side of said second shaft-bush from said fluid passage.

3. The control valve assembly according to claim 2 wherein said holding member is provided with at least one aperture for allowing flow through said fluid passage and said recess.

4. The control valve assembly according to claim 3 wherein said holding member is designed such that said second shaft-bush is removably mounted.

5. The control valve assembly according to claim 3 wherein said recess is designed so as to be removably mounted.

6. The control valve assembly according to claim 4 wherein said recess is designed so as to be removably mounted.

7. The control valve assembly according to claim 1, wherein said elastic second shaft-bush and a portion of said valve shaft that contacts said elastic second shaft-bush form an interference fit.

* * * * *